United States Patent [19]

Stewart

[11] Patent Number: 4,924,924

[45] Date of Patent: May 15, 1990

[54] HAND-HELD TURNING TOOL SYSTEM

[76] Inventor: Dennis K Stewart, 2502 NW. 4th Ave., Hillsboro, Oreg. 97124

[21] Appl. No.: 111,687

[22] Filed: Oct. 20, 1987

[51] Int. Cl.[5] ..... B27C 7/06

[52] U.S. Cl. ..... 142/49; 142/36; 142/56; 16/114 R; 30/298

[58] Field of Search ..... 142/36, 42, 48, 49, 142/56; 16/110 R, 114 R, 115; 30/298 R, 514, 517, 518, 521, 524; 82/28, 31, 32, 33, 35, 37, 73, 177.1, 177.2, 489; 224/267

[56] References Cited

U.S. PATENT DOCUMENTS

| | | | |
|---|---|---|---|
| 25,818 | 10/1859 | Goodall | 30/298 |
| 81,315 | 8/1868 | West | 142/49 |
| 712,843 | 11/1902 | Paul | 224/267 |
| 2,228,888 | 1/1941 | Rock | 81/33 |

*Primary Examiner*—William Terrell
*Attorney, Agent, or Firm*—Bruce J. Fitch

[57] ABSTRACT

A system of hand-held lathe tool assemblies especially for executing large scale deep and/or hollow work efficiently and rapidly while minimizing operator fatigue. Tool working portions may be integral with their carriers or holders or may be selectively connected to them by means of a conventional chuck or collet. The butt portions of very long lathe tool assemblies permit the turner to apply forewarm and/or upper body to the tool and gain sufficient leverage to work comfortably and hence with enhanced control while performing large scale work with tool reaches from rest to tool cutting point as high as 36 inches in length. A "slicer" tool facilitates separation (and conservation) of large volumes of material without comminution in the rough shaping stages of work. Other tool forms are disclosed.

10 Claims, 3 Drawing Sheets

FIG. 8
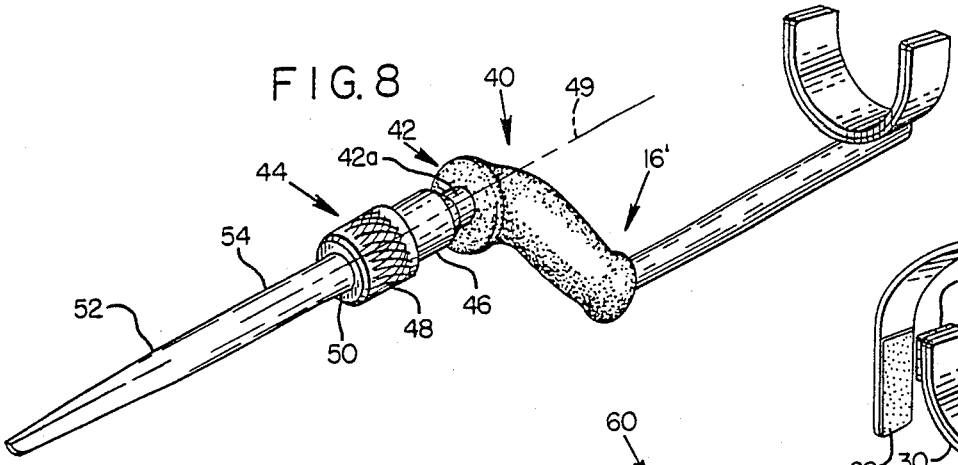
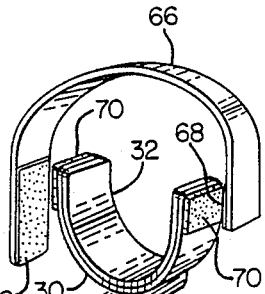
FIG. 9
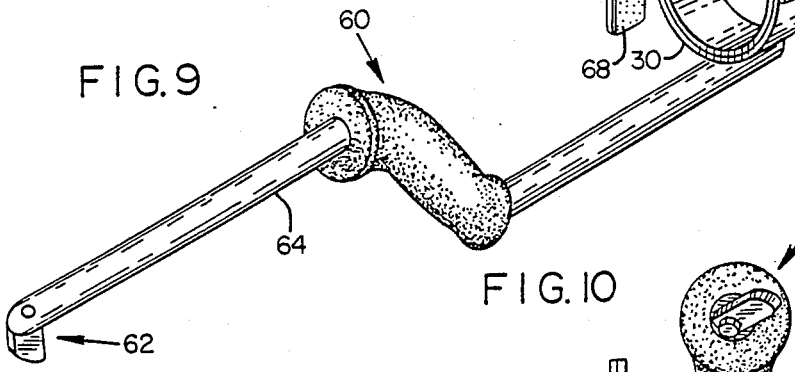
FIG. 10
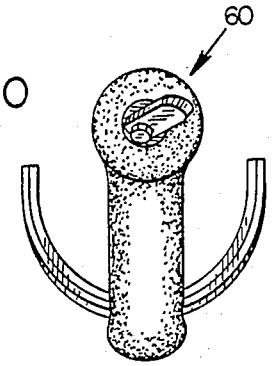
FIG. 11
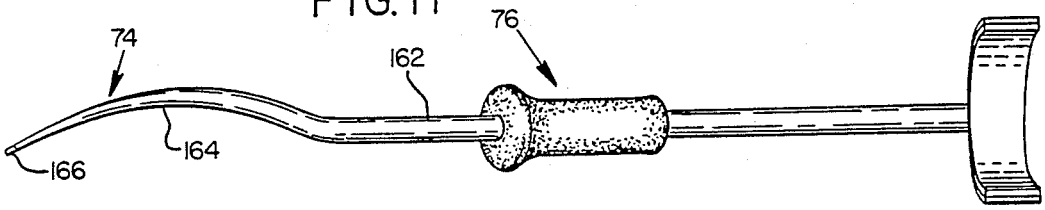
FIG. 12
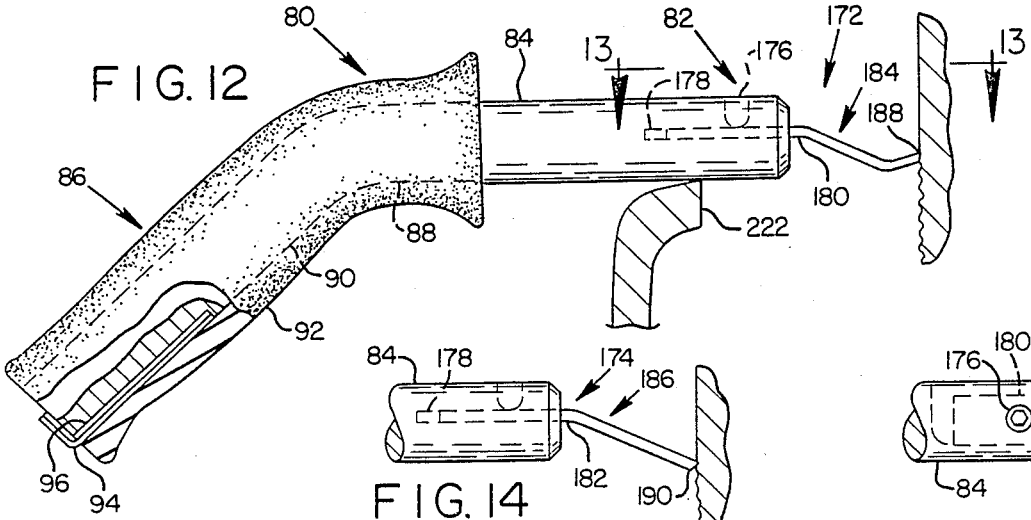
FIG. 13
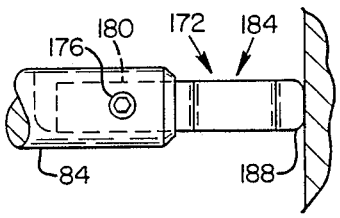
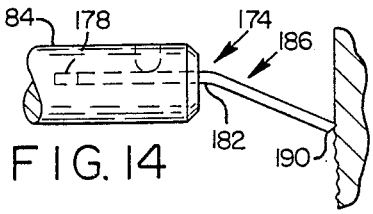
FIG. 14

HAND-HELD TURNING TOOL SYSTEM

BACKGROUND OF THE INVENTION

The invention concerns tools for turning, and especially tools for fashioning deep and/or hollow work in materials such as wood, plastics, soft metals and alabaster.

In recent years there has been a resurgence of interest in the art and craft of wood turning, including a particular interest in producing larger vessels of both the "deep" and "hollow" types. Usually the term deep refers to a cavity the internal diameter of which decreases progressively from the mouth to the bottom of the cavity. A simple example is an open cone. The term hollow refers to vessels in which there is at least one internal chamber with a mouth or entrance of smaller diameter than the maximum internal diameter of the chamber. A simple example is a sphere with a circular opening.

Two of the problems facing the turner desiring to fashion deep or hollow vessels significantly larger than those feasible and economical with conventional tools, are the volumes of material to be removed and the much greater reach of tool required. Typically these attempts at larger vessels have been made using somewhat makeshift adaptations of conventional methods and tools. The conventional way of removing redundant material is by comminution (reducing all of the material to shavings or sawdust) for example with a gouge tool. The rough forming of an extra large vessel in this way can be very laborious, time consuming and wasteful of the raw material. (Doubling the principal dimensions of a vessel increases its volume and hence the volume of material to be worked eight times.)

The second problem is the control of tools at the greater reaches involved in fashioning the inside of larger vessels. With the cutting edges of the tool more remote from the tool rest it becomes more difficult to control the tool for accurate work. A simple lengthening of the tool handle may help in holding the tool against the greater leverage resulting from increased tool reach. But typically no provision is made for holding the tool against the increased torsion forces experienced at the tool handle, especially when an offset tool is used.

A conventional tool such as a round nosed scraper may be used in a "slicing" operation to remove some volume of material, as for example in removing a cone from the end of a workpiece at the beginning of fashioning the internal form of a vessel. But the width of such tools (typically about one inch wide) wastes much material in the cuts and the operation is time consuming and inefficient.

With conventional tools, usable reach beyond the tool rest is typically of the order of two to three inches. With some adaptation greater reaches are possible, but usually only in a fatiguing operation without satisfactory control or efficiency.

SUMMARY OF THE INVENTION

Accordingly it is an object of the invention to provide a tool system especially adapted for deep and/or hollow work, including tool assemblies having configurations making it convenient and comfortable for the operator to make cuts at reaches substantially greater than conventional, while at the same time facilitating maintenance of a desired angle of presentation of the tool working portion to the work (rotational angle of tool), and maintaining precise control of depth and rate of cutting.

Another object of the invention is to provide a tool cutting or working portion having performance characteristics commensurate with the increased "scale" of work made possible by tool holders of a new order of reach. With greater reach and larger workpieces relatively much greater volumes material are to be removed and much greater surface areas are to be worked. It is also desirable to work these larger volumes and areas efficiently and with cutting procedures or methods particularly adapted to dealing with larger volumes and making more protracted cuts.

A further object of the invention is to make a functionally effective combination in one lathe tool assembly of the above-mentioned ergonomic factors, providing, at greatly increased reaches, comfortable tool control with minimum fatigue, and tool working portions commensurate with the larger scale operations made possible by the increased reach of the assembly.

In a preferred embodiment, a working or cutting portion of a tool is integral with an elongated arm-engaging and hand-grip-providing frame. A butt portion of the same may include means for engaging the arm or other portion of the body, to assist the turner in controlling the tool at the increased leverage resulting from greater reach.

The tool working portion, the tool shank portion, a transition from shank to butt and the butt may be fashioned from a continuous bar of material so that the tool working portion and shank are integral with the elongated frame. Preferably the tool tapers gently from a narrow, approximately parallel sided cutting portion to the shank portion and transition. Suitable intermediate offset or bends in the bar immediately rearward of the transition provides a handle at a suitable angle for comfortable gripping by a turner, for rotational control of the tool and resistance to torsional forces generated by cutting operation. The offset also better positions a rearward portion of the butt (which may be parallel to the tool working and shank portions), for bracing engagement by arm and/or body of the turner.

For extremely long reaches the intermediate offset in the tool frame may be dispensed with and a longer butt, with substantially no offset, but of such a size over a substantial length of the butt as to provide for comfortable prolonged engagement of the butt with upper or lower arms, and/or body of the turner with minimum fatigue may be provided. In this substantially straight embodiment of the tool, a handle for rotational control of the tool may extend generally radially from a forward portion of the butt.

A characteristic of hand-held long-reach lathe tool assemblies according to the invention, is that they are adapted to engage a tool rest at a portion of their frame forward of the hand grip or handle, and that the frame extends sufficiently rearwardly for engagement with a turner's arm or body, so that he may better control the tool while balancing the leverage generated by its cutting action.

Utility may be enhanced by making a forward portion of the lathe tool assembly, including the working portion, detachable from the frame so that a common butt and transition portion may be used for a variety of tool working portions and shank lengths. An added advantage of this arrangement, is that it may provide for provide rotational adjustability for the frame in relation to the tool working portion. The turner may, at the same time, set the tool for its best rotational angle for cutting and the butt of the frame for most comfort and control.

A preferred form of working portion of the tool is the "slicer", which is especially compatible with long reach deep and/or hollow work (although its application is not limited to such). Its narrow, approximately square tip, with short side flanking cutting edges ahead of a long gently tapering portion, suits it for "plunge" or "slicing" cuts of unconventional depth. A flank of the tool rearward of the tip may be approximately coplanar with the upright side of the tip and may be rested against the workpiece for a stabilizing or guiding or gauging effect.

The cutting tip of the slicer tool may be similar to that of a parting tool. When combined with a tool frame according to the invention, it becomes a multi-purpose tool capable of performing old functions in new ways. For example, in an early step of forming a deep work a cone may be removed as a first step, by making a series of suitably angled plunge cuts in an end face of the work. Suitably sequenced and angled, these plunge cuts may rough form the inside of the deep or hollow work, proceeding to the apex of the cone and releasing a possibly reusable cone of material rather than the potential waste of producing a volume of sawdust or shavings.

An advantage of the slicer tool, is that in surface work, such as thickness reduction or a facing cut, the tool working portion and the cut are parallel to the workpiece surface so that the turner can easily see and control his depth of cut.

The reach and control given the turner by tool holders or frames according to the invention makes possible the use of offset or bent or curved tool working portions for improved working access particularly in hollow work. Specialized cutters or blades may be included in the working portions, such as an obliquely and adjustably angled scraper blade for smooth finishing in hollow work.

The combination of tool holder or frame and tool working portions according to the invention, results in a cutting system potentially significantly more productive and efficient than conventional cutting systems. Large scale, deep and/or hollow work of dimension and form difficult or impossible with conventional tools may be performed with precision to fine finish with minimum operator fatigue. Conservation of work material is possible through the slicing removal of substantial blocks of material rather than by comminution.

BRIEF DESCRIPTION OF THE DRAWINGS

FIG. 8 is a view similar to FIG. 1 of a second embodiment of the invention.

FIG. 9 is a view similar to FIG. 1 of a third embodiment of the invention.

FIG. 10 is a front view of the embodiment of FIG. 9.

FIG. 11 is a top view similar to FIG. 2 of a fourth embodiment of the invention.

FIG. 12 is a right-hand side elevation of a fifth embodiment drawn to a larger scale than the previous figures.

FIG. 13 is a partial overhead view of the fifth embodiment taken approximately on line 13—13 of FIG. 12.

FIG. 14 is a partial side elevation, similar to FIG. 12, of a variation of the fifth embodiment.

DESCRIPTION OF THE PREFERRED EMBODIMENT

Figure 1:
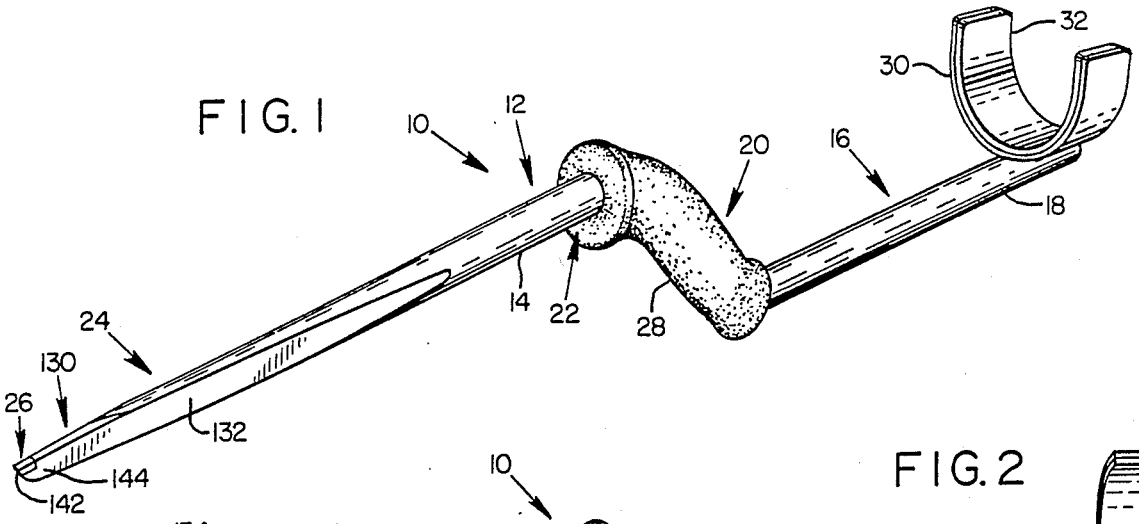
FIG. 1 is a left-hand front perspective of a lathe tool assembly embodying the invention.

A hand-held lathe tool assembly 10 embodying the invention is illustrated in FIGS. 1 through 7.

A main frame 12 of the assembly is formed from a round steel bar of uniform cross section. It includes a forward shank portion 14 and a butt portion 16 comprising an elongated rear butt portion 18 and an inclined handle 20 connected to the shank 14 by a transition portion 22. Integral with and forwardly extending from the shank 14 is a narrowly tapering tool working portion 24 with a narrow working tip 26. The tool working portion in this first embodiment may be called a "slicer" and will be described in more detail below.

Figure 3:
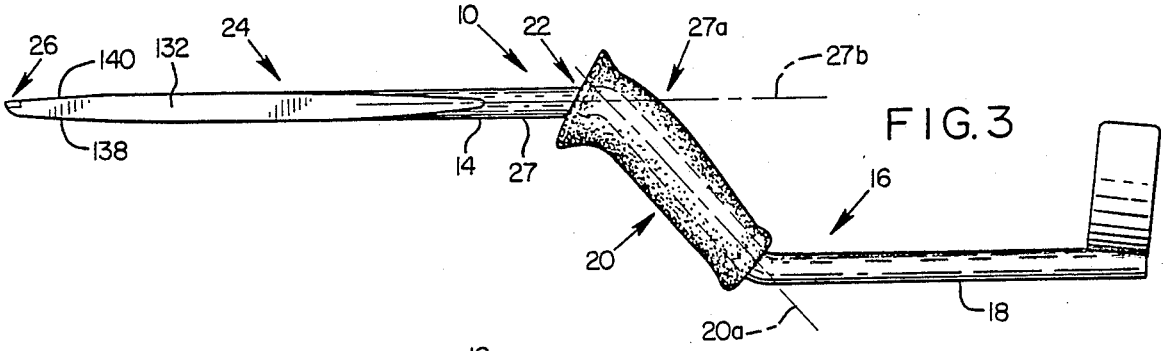

The transition portion 22 includes a forward straight portion 27 which is directly connected to and coaxial with the shank 14 and may be considered a forward tool receiving portion of a tool holder which comprises butt portion 16 and transition 22. The longitudinal axis 20*a* of the handle 20 extends obliquely from the transition portion 22 and preferably extends downwardly and rearwardly (when in use), diverging at an acute angle from a rearward extension 27*b* of the longitudinal axis 27*a* of the forward tool receiving portion 27, as indicated in FIG. 3. In operation, the axis 27*a* becomes an axis of rotational adjustment for the tool (shank 14 and working portion 24) as explained below. Rear butt portion 18 is preferably approximately parallel to the tool receiving portion axis 27*a*.

The handle 20 is cushioned by a sleeve or hand grip 28 and the rearward end of the butt 16 carries an approximately semi-circular upwardly open cradle 30 which has a lining 32 of a shock absorbing resilient material such as sponge rubber. The cradle 30 is rigidly attached to the rear butt portion 18 and, as the drawings show, is generally symmetrically aligned with the butt, but inclined somewhat rearwardly.

In a second embodiment of the invention (FIG. 8) the lathe tool assembly 40 is, from the transition 42 rearwardly, essentially the same as the first embodiment. But in this case the transition 42 carries a chuck or collet assembly 44, which includes a sleeve 46, rigidly and concentrically attached to the transition 42, and a knurled nut 48.

The chuck assembly 44 is thus coaxial with a forward portion 42*a* of the transition 42 and their common longitudinal axis 49 corresponds to the axis of rotational adjustment 27*a* of the embodiment of FIGS. 1–7. Together, chuck assembly 44 and forward transition portion 42*a* may be considered a forward tool receiving portion of a tool holder which also includes butt portion 16, and the remainder of transition 42.

Manipulation of the nut 48 actuates conventional tool gripping jaws 50. A slicer tool working portion 52 of the same general for as that of FIG. 1, supported by a shank 54 in the collet 44, is shown as an example of the tools which may be used interchangeably in this tool assembly.

In a third exemplary embodiment, (FIGS. 9 and 10) the lathe tool assembly 60 again has a tool working portion 62 integral with a shank portion 64. This scraper type working portion will be described below. FIG. 9 also illustrates an optional retaining strap 66 for use with lathe tool assemblies which include the forearm receiving cradle 30. Any suitable strap arrangement may be used. In this example VELCRO TM material, a synthetic which adheres when two pieces are pressed together, is used for the fastener. VELCRO areas 68 on the strap 66 mesh with VELCRO pads 70 on each opposite side of the cradle 30 to provide adjustability of the strap.

In a fourth embodiment (FIG. 11), the modified slicer working portion 74 of the lathe tool assembly 76 will also be described in some detail below.

A fifth exemplary embodiment lathe tool assembly 80 (FIGS. 12 to 14) includes the basic elements of the previous embodiments except that the butt portion is curtailed and limited to the downwardly and rearwardly inclined handle portion (90). It includes a forward working portion 82 integral with a shank 84 and butt portion 86 offset downwards from a transition 88 to form a handle portion 90 cushioned by a hand-grip 92. In this embodiment the handgrip is preferably of a resilient material somewhat stretched to fit over the butt handle portion 90, so as to retain a small wrench or key 94, used in tool adjustment, stowed in a keyway-like slot or groove 96 on the underside of the handle 90. A chatter tool working portion (82) is illustrated in this embodiment and will be described in some detail below.

The sixth embodiment (FIGS. 15 and 16) is of the same general form as the fifth embodiment (FIG. 12) but here the lathe tool assembly 100 is more elongated and the slicer-type working portion 102, also to be discussed below, is included.

The lathe tool assembly 110 of a seventh embodiment (FIGS. 17 and 18) is similar to the second embodiment, (FIG. 8), in being designed to accept the shanks of a variety of tool working portions. But it is potentially of significantly greater overall length in that the transition 112 is much elongated between the butt portions 114 and the shank accepting socket 116. Also the butt rear portion 118, rather than being offset, is coaxial with the transition 112. The extra length of butt 114 allows the turner to brace the tool with his body, possibly with the butt between arm and body. The butt 114 is preferably cushioned with a sleeve 119 of resilient material such as sponge rubber. Rearwardly and downwardly extending handle 120 gives depth to the assembly, providing mechanical advantage for torsion control as in other embodiments. The shank receiving socket 116 relies on a set screw 122 provided with a wrench handle 124 to retain a shank carrying a working portion. The exemplary tool working portion 126 in this embodiment is of the scraper type and is shown mounted in socket 116 only in FIG. 18.

The exemplary tool working portions forming part of the lathe tool assemblies shown in the drawings and mentioned above will now be described in more detail.

In the embodiment of FIGS. 1 through 7, the tool working portion 24 is of the slicer type. The basic form is of a straight bar tapered to a long narrow upright working tip 130. In preferred embodiments the working portion 24 is formed by reducing a straight bar of uniform cross section—in this case the round bar forward extension of the shank 14. Preferably, the principal taper is taken all on one side of the bar as in the upright tapered flat side 132 shown in the drawings. A short flat or undercut 134 is made on the opposite side to produce the nose 130, the opposite lateral sides of which are approximately parallel. The cutting tip 26 therefore is offset from the longitudinal axis of the shank 14 to be in substantial alignment with a side of the shank 14. For improved tool life and performance a carbide tip 136 may be inserted at the cutting tip 26. The position of the cutting tip 26 is somewhat above the longitudinal axis of the shank 14. The cutting tip 26 is maintained (by grinding) so that its opposite sides are approximately parallel and flush with the opposite sides or walls of the nose 130, and so that a front transverse cutting edge 142 and short opposite side cutting edges 144 are maintained. To reduce friction, especially in initial plunge cuts, the insert tip 136 may be somewhat wider than the nose 130.

Figures 15, 16, 17, 18, 19, 20, 21, 22, 23, 24:
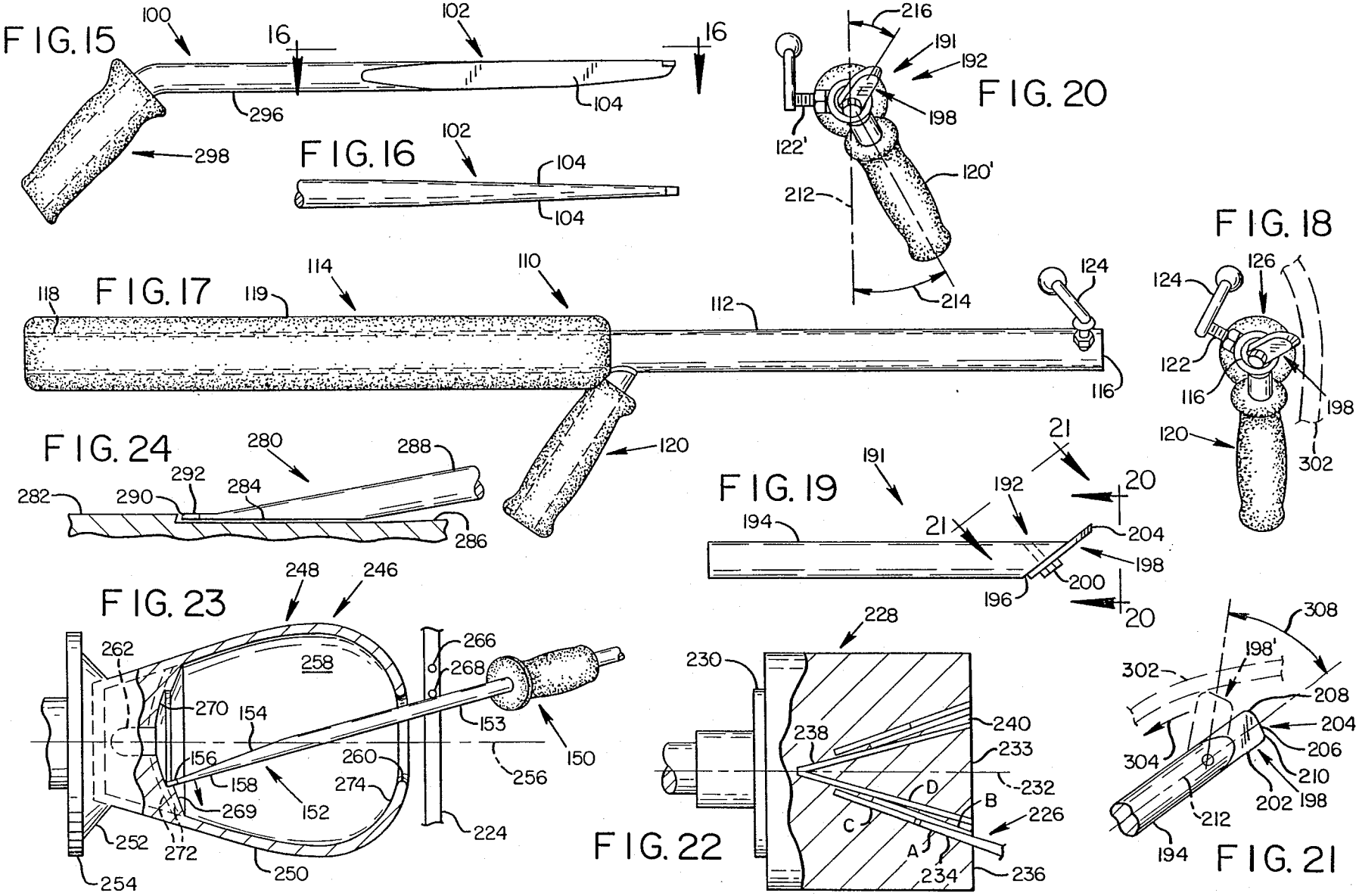
FIG. 15 is a right-hand side elevation similar to FIG. 7 of a sixth embodiment.
FIG. 16 is a partial overhead view of the sixth embodiment taken approximately on line 16—16 of FIG. 15.
FIG. 17 is a right-hand side elevation similar to FIG. 7 of a seventh embodiment of the invention.
FIG. 18 is a front view of the embodiment of FIG. 17 with a tool working portion similar to that of FIGS. 9 and 10 installed in its tool holding socket.
FIG. 19 is a right-hand side elevation of a tool assembly with a tool working portion similar to that of FIGS. 9 and 10 and a shank for mounting it in a suitable tool holder such as those of FIG. 8 and FIG. 17.
FIG. 20 is a front view of the assembly of FIG. 19 installed in a holder similar to that of FIG. 17.
FIG. 21 is a partial overhead view of the tool working portion of FIG. 19.
FIG. 22 is a schematic representation of a plunge cutting and material removing operation using a tool similar to that of the first embodiment (FIGS. 1–7).
FIG. 23 is a schematic representation of a side cutting operation for forming an internal cavity using a tool similar to that of the first embodiment (FIGS. 1 through 7) but having a tool working portion of heavier construction.
FIG. 24 is a somewhat schematic representation to a larger scale of a tool working portion similar to that of the first embodiment making a surface cut.

A side cutting version of the slicer tool is shown in FIG. 23. The general form of the lathe tool assembly 150 and the tool working portion 152 extending from shank 153 are as in the embodiment of FIG. 1. The taper in the working portion 152 is still asymmetrical, but the taper of the flat side 154 is more abrupt being about 6 degrees compared with the 3 degrees of the slicer tool of FIG. 1. The cutting tip 156 may also be somewhat wider than the working portion nose 158, but the basic alignment of the cutting tip 156 remains with the tapered flat 154. Optionally, the short flat or undercut corresponding to the flat 134 of the first embodiment, seen best in FIG. 7, may be omitted.

FIG. 11 illustrates another variation of the slicer tool. Here the lathe tool assembly 76 includes a bowed or hooked slicer working portion. As in the first embodiment (FIG. 1), the tool working portion 74 is integral with a straight shank 162. But the working portion 74 is bowed to one side in a gentle bow 164 which places the cutting or working tip 166 slightly offset to the opposite side of the longitudinal axis of the shank 162.

A further variation of the slicer tool is incorporated in the lathe tool assembly 100 of FIGS. 15 and 16. The tool working portion 102 is symmetrically tapered with equal flats 104 on each side.

A second type of tool working portion 82, the chatter tool, is shown in FIGS. 12 to 14, in two variations. The principal element in both is the blade (172, 174 respectively), with the form of FIG. 12 particularly suited to metal working while that of FIG. 14 works well in wood cutting. In each case the blade is supported cantilever fashion, clamped by a set screw 176, retaining it in a slot 178 in a forward extension of the shank 84. In both cases the blade is made of resilient steel and clamped or held by a tongue portion 180, 182 within the slot 178, while the cantilevered portion 184, 186 slopes forwardly and downwardly to a cutting tip 188, 190. In the metal working version (FIG. 12 and 13), the tip 188 is bent upwards to an angle somewhat above the horizontal, but in both cases the working tips are carried at a level approximately coinciding with the lower side of the shank portion 84.

A third main type of tool working portion, the scraper tool, is illustrated in FIGS. 19 to 21 as well as being shown in FIGS. 9, 10 and 18. In FIG. 19 the tool working portion 192 of tool assembly 191 is shown in side elevation only with a shank 194. In this form it may be used for example with the tool carrier of FIG. 17 (as illustrated in FIG. 18), or mounted in the collet or chuck 44 of the tool carrier or holder of FIG. 8. In both cases the combination constitutes a complete lathe tool assembly. This is of course only one example of the variety of "shanked" tools that may be used in combination with a tool holder or carrier in this system.

In the embodiment of FIG. 19 the round bar of the shank 194 extends into the tool working portion 192 and is cut off at an oblique angle to provide a planar blade support surface 196. A cutter blade 198 is secured to the blade support surface by a retaining bolt 200. The exemplary blade body 202 is approximately rectangular and includes at one end the working tip or cutting edge 204 which has an approximately transverse front portion 206 and, continuing onto the sides of the body, rounded corner cutting edges including a nose or a toe portion 208 and a heel portion 210. As the names imply, in terms of radial distance from the longitudinal axis of the shank 194, or from retaining bolt 200, the nose or toe cutting edge portion 208 is further out than the heel portion 210. As indicated in FIG. 21 the blade may be pivotably adjusted to either side of the shank by loosening and tightening the retaining bolt 200. The blade 198 may take a variety of forms including, for example, being a circular disc, and the cutting edge contour may be varied to suit particular jobs. But it is preferably always adjustable.

In FIG. 20 the tool assembly 191 of FIG. 19 has been placed in a tool carrier similar to that illustrated in FIG. 17 and locked by means of the set screw 122' in a particular rotational relationship with the carrier. For reference purposes, a plane passing through the longitudinal axis of the shank 194 and perpendicular to the blade support surface 196 (see FIG. 19) has been designated as a principal plane of the tool assembly 191. This plane is indicated in FIGS. 20 and 21 by the numeral 212. In the "application" view (FIG. 20) the principal plane 212 makes an acute angle 214 with the axis of the handle 120'. In terms of tool setting this is of course equivalent to rotating the tool working portion 192 and hence the blade support surface 196 clockwise through the same angle 214 with respect to the handle of the tool carrier as viewed from the front of the lathe tool assembly. A related tool setting step is setting the blade 198 with respect to the principal plane 212. In this example the blade has been rotated through an acute angle 216 clockwise from the principal plane 212, again as viewed from the front of the lathe tool assembly.

Turning now to some aspects of the operation, advantages and features of lathe tool assemblies according to the invention—the embodiment of FIGS. 1 to 7 is a good example of the integration of a tool working portion 24 of special capability with the ergonomically sound handling system represented by the appropriately angled handle 20 (typically engaged by the turner's right hand), and the rearwardly extending rear butt portion 18 carrying the cradle 30 for bracing engagement of the turner's upper forearm.

Other examples of integrated or unitary lathe tool assemblies of the same general form as FIG. 1 are, the embodiments shown in FIGS. 11 and 23, both of which are variations of the slicer tool, and FIG. 9 which has the scraper tool working portion 62.

An added convenience of configurations with the arm engaging cradle at the end of the butt, such as cradle 30 in FIG. 1, is that they can be stood on end when not in use. The chosen angle of inclination of the cradle 30 to the rear butt portion 18 is such that, when upended, the center of gravity of the total lathe tool assembly falls within the base established by the cradle 30. A similar result in terms of operational characteristic and convenience follows from the combination of the tool carrier configuration of FIG. 8 with any given shanked tool assembly such as 191 of FIG. 19.

The "tool carrier" configuration of FIG. 17, when combined with a shanked tool assembly such as that of FIG. 19, has the potential for even greater overall length in a tool assembly than those just mentioned.

The same principles of control, comfort and convenience in operation are maintained also in the integrated tools exemplified by the chatter tool of FIG. 12 and the slicer tool of FIG. 15, but these lack the means for secondary bracing or support of the tool by the turner's arm or body.

In typical turning operation, tools are usually supported on generally horizontally extending rests (see for example rests 222, 224 in FIGS. 12 and 23 respectively), and tool working portions and shanks are maintained approximately in a horizontal plane approximately defined by the tool rest and passing through the axis of rotation of the workpiece. In all discussion herein it is assumed that a workpiece surface engaged by a tool is moving downwards relative to the tool.

In operation, the rotational position of the tool working portion or shank supported by a rest may be adjusted to optimize the attitude of the cutting portion of the tool to the workpiece. In any elongated tool therefore such as those shown in FIGS. 12 and 23, the longitudinal axis of the shank may be considered an axis of rotational adjustment.

In general, the tool system described above makes it possible to operate at greater reaches (distance from tool rest to cutting tip or cutting edge of tool) generating relatively much greater forces to be balanced by the turner. The elongated butts of the tools such as butt 16 of the embodiment of FIG. 1 and butt 114 of FIG. 17 help supplement the force which can be applied at the handles (20, 120) by allowing the turner to bring other parts of his body to bear on the lathe tool assembly. For example, in the embodiment of FIG. 1 the underside of the turner's forearm can bear down on the cradle 30 to provide the leverage necessary to balance tool working forces. In the longer tool assembly of FIG. 17 the butt 114 may be braced between arm and body and the turner's whole body weight is available to stabilize the tool. The turner's hand (usually the right) grasping the handle not only contributes to the balance of forces in a vertical plane, but also, because of the radial extension of the handle outwards from the axis of rotational adjustment (shank or tool working portion supported on the rest) gives the turner sufficient mechanical advantage, in a torsional direction, to comfortably control the rotational attitude of the tool. He is well-positioned, not only to balance any torsional forces induced in the tool by a resultant cutting force offset from the axis of rotational adjustment, but also to finely control the attitude of the workpiece engaging portion of the tool. A relatively large movement of his hand results in only small movement of the tool cutting edges (if these are close to the axis of rotational adjustment) so that very precise control can be maintained. Similarly the greater overall length of the lathe tool assembly has the potential for achieving more precise control of the tool in vertical and horizontal directions. The design of the tool permits comfortable control with one arm so that the turner's other hand (usually the left) is free if desired to steady the tool close to the rest, possibly grasping the rest and tool together to provide a fulcrum for tool movement or adjustment. Lathe tool assemblies according to the invention permit a turner to produce good quality work even with complex forms and at great reach with a minimum of fatigue. (When longer tools are used the turner's comfort and safety are enhanced by the greater distance of his face from the work).

A method of using the slicer tool (FIG. 1) to great advantage is illustrated diagrammatically in FIG. 22. This is an example of "plunge" cutting using a tool working portion 226, similar to that of tool working portion 24 of FIG. 1. In a conventional way, a workpiece 228 is secured to a face plate 230 for rotation about an axis of rotation 232. The purpose of the operation is to remove a cone 233 from the center of the workpiece. This may be a first step in creating a piece of deep hollow work. The wall of the remaining conical cavity, which may be considered a finished face, is indicated by the numeral 234. The method is as follows:

1. Presenting the tool cutting edge to the workpiece surface 236 parallel to the finished wall 234 of the proposed cavity and disposed so that a first cut will begin definition of the cavity.

2. Advancing the tool substantially along an extension of the longitudinal axis of the tool working portion 226 to make a first cut penetrating a substantial length of the cutting portion of the tool. This cut is indicated at A in FIG. 22.

3. Withdrawing the tool from the workpiece.

4. Re-presenting the tool to the workpiece surface 236, at a second position immediately alongside the first cut.

5. Advancing the tool substantially parallel to the first cut to make a second cut of depth significantly greater than the first cut (cut B). This cut is possible because of the slender taper of the tool working portion and the clearance provided by the first cut.

6. Withdrawing the tool from the workpiece.

7. Re-presenting the tool to the workpiece surface 236 and advancing it substantially along the line of the first cut a to make a third cut C to a depth significantly greater than the second cut B. Again this cut is made possible by the slender nature and length of the tool and the clearance provided by the previous two cuts.

8. Representing the tool to the workpiece surface 236 radially inward of the previous cuts and spaced about two (to four) cutting widths distant from the first cut and angling the tool approximately towards the apex 238 of the intended cone.

9. Advancing the tool along this direction to make a fourth cut D to intersect the finished face 234 adjacent the intended cone apex 238. The positioning and direction of cut D defines a frusto-conical annulus 240 which typically splits and breaks up and becomes removable during the course of cut D. The great depth of plunge cut D is made possible by the narrowly tapered form of the tool and the clearance provided by the previous cuts made by the same tool and by the positioning of the cuts to define the annulus (240) which is removable during the course of the final cut. At the completion of cut D the cone 233 can be broken out. Note that cut D is not necessary to the method even though it is often expeditious. For example, if workpiece and tool dimensions permit, cut C may be a final cut. Or, in larger dimensioned work, the sequence of parallel cuts (A,B,C) may be supplemented by additional side-by-side stepped cuts.

An essentially similar method (not shown in the drawings) may be used in other applications, for example in reducing an elongated irregularly shaped workpiece to cylindrical form. With the piece rotating about a longitudinal axis a series of preparatory "parting" cuts are made, radially inwards to just short of the surface of the intended cylinder and suitably spaced along its length. If the depth of these cuts requires it they may be made by a sequence of side-by-side cuts with a slicer tool such as that of FIGS. 1–7. The radial cuts will have defined a series of "rings" which may now be removed by a procedure similar to that described above for the cone removal. The work is again entered from an end face but may be oriented so that the radially innermost cut roughly defines the surface of the intended cylinder. Sufficient cuts are made to penetrate to the first "parting" cut and so the first ring is separated and may be removed by taking it over the end of the work or by splitting it.

FIG. 23 illustrates somewhat schematically another capability of a tool of the slicer type; side cutting to remove material from deep within the cavity of a piece of hollow work. The workpiece 246, a partially formed vase 248 has a substantially finished exterior surface 250, but an unfinished base 252 remains for attaching it to a conventional face plate 254 for rotation about an axis of rotation 256. Access to the partially completed inner chamber 258 is through the small diameter mouth 260. The work of removing material to form the chamber 258 has been facilitated by boring an axial pilot hole 262. A conventional tool rest 224 extends horizontally across the mouth 260, spaced slightly below the axis of rotation 256. The rest has a plurality of spaced holes 266 (only two of which are indicated in the drawing), for positioning an upstanding pin 268, useful as a fulcrum and stop for a tool in work.

A method for creating the cavity 258 includes the preliminary steps already indicated above, such as mounting the workpiece on the face plate as shown in the drawing, boring the pilot hole 262, and arranging the rest 224, with its adjustable fulcrum pin 268. Additional steps in the method include:

1. Providing a generally straight elongated lathe tool having a narrow working tip with adjacent front and side short cutting edges and a rearwardly extending butt, with the overall length of the tool being approximately at least twice the intended depth of the chamber. A suitable tool is the lathe tool assembly 150 described above and shown in FIG. 23. Although it is of the slicer configuration (similar to FIGS. 1–7), a relatively steep 6 degrees taper makes its tool working portion 152 less flexible under side loading as is desirable in this application.

2. Supporting the tool working portion 152 on the rest 224, engaging the tool with the pivot pin 268 and sliding the tool forwards so that the cutting tip 156 enters the pilot hole 262.

3. Biasing the tool against the pivot pin 268 in such a direction that the left side cutting edge of the cutting tip 156 is at least partially engaged with the pilot hole adjacent the workpiece surface 269 to be cut.

4. Maintaining the bias on the tool so that the tool cutting tip 156 moves approximately circumferentially with respect to the fulcrum pin 268, cutting generally radially outwards from the pilot hole 262, and thus generating a cut surface approximating a portion of a sphere, as indicated at 270 (and 269).

5. Terminating the cut upon reaching a predetermined inside dimension of the chamber 258.

Successive cuts are made in a similar way indicated by the lines 272 in FIG. 23.

Another important use of the slicer tool is that of making cuts parallel to an existing surface and may be described with reference to FIGS. 22 and 24. In at least the first half of cut B the tool is taking a surface cut (on a conical surface). Similarly in cut C the first half of the cut is the equivalent of a continuing finishing cut to establish the conical surface 234. These cuts may be of a thickness up to the width of the tool and guidance and stability of the tool may be assisted by the sides of the tool rearward of the cutting tip rubbing against the surface just cut. An advantage of the slicer tool is the ease of controlling the depth of cut. In initiating a cut such as cut B in FIG. 22 for example, the turner can present his tool to the end surface (236) of the workpiece and position it to establish the desired cut. Then as the cut progresses, with the tool working portion parallel to the surface the depth of cut can be easily monitored and maintained. These remarks apply particularly to the use of straight tool working portions such as 24 of FIG. 1 making straight cuts as in FIG. 22, and also to cutting on convex surfaces (not shown in the drawing). With the bowed or hooked modification of the slicer tool (similar but opposite to working portion 74 in FIG. 11) the same procedures can be followed for surface cuts on concave surfaces such as finishing cuts on the inside of a bowl. The hooked form may also be used to reach "around corners" to work on surfaces such as surface 274 under the lip of opening 260 in FIG. 23. Another use is in the separation of "nesting bowls" from a workpiece.

FIG. 24 illustrates a typical slicer tool working portion 280 making a parallel surface cut in a workpiece surface 282. The flat left-hand taper face 284 bears against the freshly cut surface 286. Note that in FIG. 24 the taper angle of the "flat" 284 has, for clarity, been greatly increased over the preferred 3°–6°. It can be seen that this tool configuration angles the tool shank 288 away from the work in progress, s that, in fact, gentle inside curves (concave surfaces) may also be made with this nominally straight tool. As can be seen in the drawing the front cutting edge 290 of the cutting tip 292 is angled to create a "left-hand point". In operation, this angularity tends to urge the point to the left at least sufficiently to maintain depth of cut and help in achieving a smooth surface. Other variations in the front cutting edge such as a right-hand point or a round nose may be used for particular operations but a square cut is the most universally useful.

As already indicated, the straight slicer tool (FIGS. 1, 15, 16, 23 and 24) may have left- or right-hand taper or be symmetrically tapered as in FIGS. 15 and 16. One or more versions is chosen to suit the job in hand. Considerations include clearance requirements for shank and frame or handle, especially when a long reach assembly is used. The longitudinal angle at which the tool must be held relative to the work depends partly on the taper form with the result that one version may provide better clearance for portions of the workpiece or the lathe tailstock than another.

Lathe tool assemblies according to the invention and exemplified by the embodiments of FIGS. 1, 8, 9, 11, 15, 17 and 23 are all inherently adapted for turning operations at reaches significantly greater than conventional. In all configurations the basis for the increased reach capability is the form of the butt of the tool which gives the turner the mechanical advantage (leverage) to comfortably resist forces generated by the turning operation, not only in the vertical and horizontal planes but also torsional forces. Under less physical strain he can better control his tools and achieve more precise results. Even the integrated pistol-grip slicer tool of FIG. 15 which, unlike the other configurations enumerated above, has a relatively short butt designed for engagement only by the hand of the turner, because of the combination of the relatively long shank 296 and the depth and angularity of the handle 298, has the potential for adequate control in long reach cutting operations.

Of the lathe tool assembly configurations shown in the drawings, the intermediate length represented by FIGS. 1, 8, 9 and 11 is usable for a broad range of effective reaches (from the rest), and some typical dimensions will now be given.

Figure 2:
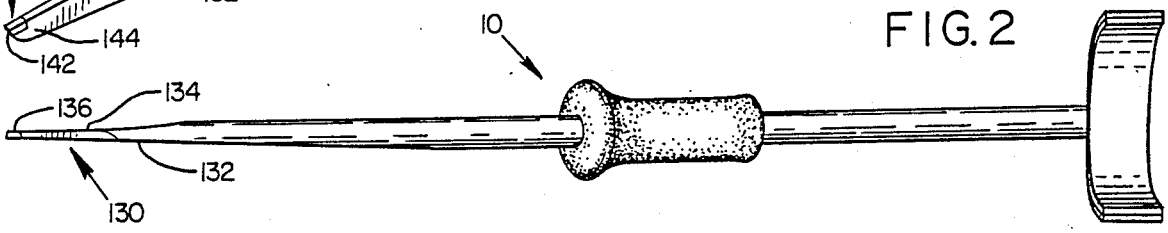
FIGS. 2 through 7 are respectively top, left-hand side elevation, bottom, rear, front, and right-hand side elevation views of the embodiment of FIG. 1.
Figure 4:
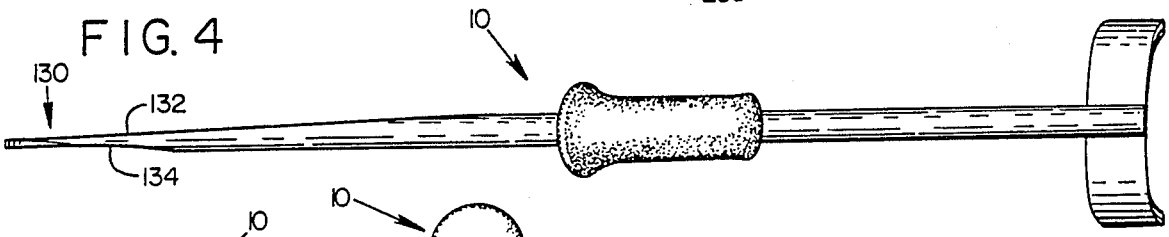
Figure 6:
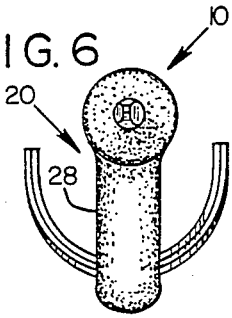
Figure 5:
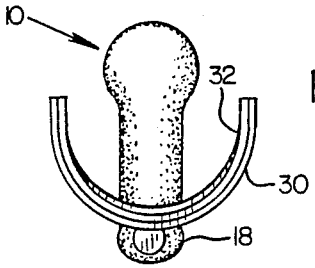
Figure 7:
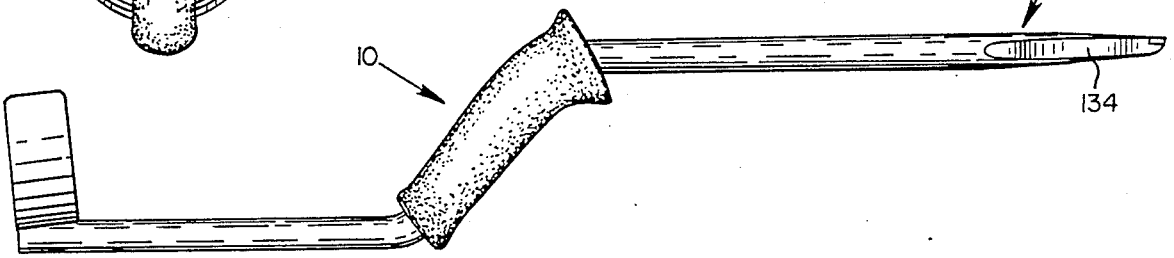

With particular reference to FIG. 1, the lathe tool assembly 10, including slicer tool working portion 24—overall overall length is 27 inches and from transition 22 to cutting tip 26, 15 inches. The handle 20 is approximately 5 inches long and is bent downwards from the horizontal preferably more than 45 degrees. The resulting downward offset of the rear butt portion 18 is approximately 4 inches and it is about 9 inches long. The frame bar 12 is made from ¾ inch round bar of suitable material such as 4140 steel. Other bar cross-sections may be used, such as hexagonal or square but the bar is preferably of uniform cross-section along its length. The slicer tool working portion 24 (cutting tip 26 to end of tapered flat 132) is 11 inches long with a three degree taper as viewed from top or bottom (FIGS. 2 or 4 respectively). The carbide insert 136 forming the cutting tip 26 is ¼ to ⅜ inches long with a cutting width of 1/16th to ⅛ of an inch. This working portion is useful for initial, opening plunge cuts up to 1—2 inches deep and reaches up to 13 inches from a rest. Similar dimensions apply to FIGS. 8 (with tool), 9 and 11 except of course for the working portion dimensions and the depth of plunge cut possible.

The slicer tool assembly 150, adapted for side cutting and shown in FIG. 23, may have similar overall dimensions to the assembly 10 of FIG. 1, but its tool working portion 152 is more abruptly tapered (at 6 degrees) as seen in the overhead view of FIG. 23, and the cutting tip 156 is wider ⅛ to 3/16th inches.

The pistol grip slicer tool assembly 100 of FIG. 15 may have an overall length of about 15 inches and an effective reach up of to 7 inches from a rest.

The longer reach lathe tool assembly 110 of FIGS. 17 and 18 may have an overall length of about 50 inches with an effective reach of 20 to 24 inches. Effective reaches up to 36 inches from a rest are feasible with hand-held lathe tool assemblies of this general configuration.

In bowed slicer tool assemblies similar to that of FIG. 11, the bow portion 164 may usefully have a bow radius of 1 to 6 inches and a bow length of 2 to 8 inches. The cutting tip 166 may be offset about ½ inch to the opposite side of the longitudinal axis of the tool while the depth of the bow from the longitudinal axis is about 1–3 inches.

Successful operation of the chatter tool assembly 80 shown in FIGS. 12 to 14 depends on establishing a frequency of oscillation for the blade 184, 186 effective to produce a desired finish or effect on the surface of the workpiece. Conventionally chatter work is done with a tool having a rigid blade, held loosely by the turner so that vibration or oscillation can take place. With tools according to the present invention, desired results are much more predictably and consistently obtained. The tool is held firmly on rest 222 and for a given speed of the workpiece surface relative to the tool, and for a given material, the frequency of oscillation or vibration of the blade depends on the length of the cantilevered portion of the blade. Frequency characteristic is readily changed by adjusting the cantilevered or free length 184, 186 of the blade by loosening and tightening the set screw 176. Best finished results are obtained by using a blade form and tip suited to the material being worked. For example, a chatter tool for metal working requires the more aggressive chatter inducing form 184 of FIG. 12 with the upwardly or forwardly raked tip 188. For relatively softer materials such as wood the simple backwardly raked form 186 of FIG. 14 gives good results. For many desired effects, the overall cantilevered length of the blade may be about 1 inch, while its cross section is about ⅜ inch wide by 1/16th of an inch thick. The cantilevered portions 184, 186 may be bent or inclined below the horizontal anywhere from 0 to 90 degrees (but the 30 degrees shown here works particularly well). To form the upwardly inclined tip of FIG. 12 about ¼ to ⅜ of an inch length of the blade portion 184 should be bent upwards to an above horizontal attitude. Clearly in an undeflected condition the working tip (188,190) of each blade should be somewhat below the tongue portion 180, 182 to avoid jamming.

Lathe tool assemblies with scraper working portions (FIGS. 9, 10, 18–21) are especially suited to making "down grain" cuts in wood on concave surfaces such as the inside surface of a bowl. Typical "in operation" relationship between a scraper tool blade 198' and, particularly, a blade nose portion 208' and a workpiece (bowl) 302, are shown in FIG. 21 (approximately) and FIG. 18. In FIG. 21 the principal plane 212 of the tool is shown perpendicular to the generally horizontal working plane of the tool. In many operations better results are obtained if the tool working portion 192 is rotated about 30 degrees counterclockwise as viewed from the rear of the tool by a turner, and as indicated in FIG. 20 and shown in FIG. 18. In the overhead view of FIG. 21, the workpiece 302 appears as a horizontal section on the bowl, with the tool being moved in the direction of the arrow 304. In the front end view of FIG. 18, the bowl workpiece 302 is seen in vertical section adjacent the tool blade 198. These views illustrate the "gentle" non-aggressive approach of the workpiece surface to the tool making possible very smooth finishing cuts. What is shown and described is just one example of an effective combination of rotational adjustment of shank 194 and angular adjustment of blade 198 on blade support surface 196. Both are infinitely adjustable (when the shank is gripped in a collet or chuck.)

Good results are obtained with scraper tool working portions in many materials and conditions, with angular relationships and dimensions as suggested by the drawings. The tool shank 194 (FIG. 19), may be a ¾ inch round bar and the true angle of the blade support surface 196 to the axis of the shank may be about 30 degrees (or 30 degrees above the horizontal in the upright or non-rotated condition of the tool working portion in FIG. 19). As described above, and assuming the tool is working in a generally horizontal plane at about the level of the axis of rotation of the workpiece, a good basic setting for the tool is to rotate the shank and hence the blade support surface through an angle of about 30 degrees counterclockwise as viewed from behind the tool. The true angle of rotation of the blade away from a central position may be of the order of 45 degrees as indicated at angle 308 in FIG. 21. Suitable dimensions for the blade 198 may include a length of ⅞ of 1 inch from the pivot (retaining bolt 200) with a width of about ¾ of an inch and thickness of ⅛.

In the above description, the material of the workpiece has generally been assumed to be wood. In fact the principles of the tool systems and tool working portions described here have good application in a variety of materials including also alabaster, plastics and soft metals. Only minor variations in tool dimensions, working angles, etc. are necessary to translate the working principles from one material to another.

The simplicity of the integrated or unitary tool, such as the embodiment of FIG. 1, is not only visually attractive but has some advantages in positive maintenance of alignment of the tool working portion with the tool butt or carrier and also integrity of connection between the tool and its carrier. However, the tool working portions described above, while being good examples of tools well adapted (in combination with the tool carrier systems described) to large dimension, deep and hollow work, are only examples. The embodiments of FIG. 8 and FIG. 17 with their collet and socket respectively, will accept any tool with suitable shank size, thus bringing large scale work within the reach of a wide variety of tools.

I claim:

1. A lathe tool holder for holding a lathe tool, tool holder and tool constituting an elongated lathe tool assembly in which the tool extends forwardly from the tool holder, the assembly being adapted for hand-held use by a turner for engagement of the tool with a surface of a rotating workpiece, the surface moving downwards relative to the tool assembly and the tool assembly being at least partially supported by a generally horizontally extending tool rest for operation in a generally horizontal plane of use, the tool holder comprising:

a forward tool receiving portion having a longitudinal axis approximately defining an axis of rotational adjustment;

a butt portion extending rearwardly from the tool receiving portion for holding by a turner to at least partially control the tool;

a handle included in the butt portion and extending obliquely from the tool receiving portion, the handle having a longitudinal axis and said axis diverging from the axis of rotational adjustment including a receptacle for receiving a tool and means for releasably holding the tool in the receptacle and operable to apply a torque about said axis, the tool assembly being adapted to receive the support of the tool rest at a forward portion of the assembly, said rest having a tool supporting surface defining approximately the generally horizontal plane of use;

an elongated rearward extension of the butt portion extending from the handle and approximately parallel to and offset from the tool receiving portion;

upwardly open cradle means carried by the rearward extension of the butt portion, engageable with a forearm of the turner for assisting the turner to control the tool in operation; and wherein, in operation, the handle extends generally downwardly so that the rearward extension of the butt portion is offset downwardly.

2. The tool holder of claim 1, and further including strap means engageable with a forearm of the turner for maintaining the butt portion adjacent the forearm.

3. The tool holder of claim 1 wherein the cradle means includes a stiff arcuate member opening upwards for receiving a forearm of the turner.

4. The tool holder of claim 3 where in the arcuate member has a rearward edge, said edge defining a plane approximately perpendicular to the axis of the rearward extension of the butt portion so that when the tool holder is erected on a level floor the rearward edge of the arcuate member serves as a base for holding the tool holder erect.

5. The tool holder of claim 1 wherein the tool receiving portion, the handle portion of the butt and a rearward portion of the butt are all approximately coplanar.

6. The tool holder of claim 1 wherein the butt portion is formed substantially from one continuous length of material.

7. The tool holder of claim 6 wherein the continuous length of material is a metal bar of uniform cross section.

8. The tool holder of claim 7 wherein the handle carries grip means for improving the grip of the turner.

9. The tool holder of claim 1 wherein the receptacle and the means for releasably holding comprise a chuck.

10. The tool holder of claim 1 wherein the longitudinal axis of the handle diverges at an acute angle from a rearward extension of the axis of rotational adjustment.

* * * * *